US005156220A

United States Patent [19]

Forehand et al.

[11] Patent Number: 5,156,220

[45] Date of Patent: Oct. 20, 1992

[54] WELL TOOL WITH SEALING MEANS

[75] Inventors: Richard L. Forehand, Spring; Douglas J. Murray, Humble; Mark E. Hopmann, Alvin, all of Tex.; Ronald D. Williams, Morris, Okla.

[73] Assignee: Baker Hughes Incorporated, Houston, Tex.

[21] Appl. No.: 573,581

[22] Filed: Aug. 27, 1990

[51] Int. Cl.[5] ..... E21B 34/14

[52] U.S. Cl. ..... 166/386; 166/332

[58] Field of Search ..... 166/373, 386, 332

[56] References Cited

U.S. PATENT DOCUMENTS 3,051,243 8/1962 Grimmer et al. ..... 166/332
3,071,193 1/1963 Raulins ..... 166/332
3,395,758 8/1968 Kelly et al. ..... 166/332
3,414,060 12/1968 Zak ..... 166/332

*Primary Examiner*—Terry Lee Melius
*Attorney, Agent, or Firm*—Melvin A. Hunn

[57] ABSTRACT

A downhole well tool is provided which includes a shifting sleeve for opening a flow communication port. The well tool includes first and second primary seal elements positioned upstream and downstream, respectively, of the port as well as upstream and downstream of the threaded connections between the well tool and sections of tubing forming the well flow conduit. A fluid diffuser element may be included to abate flow damage across the primary seal elements during the shifting of the sleeve. A method of selectively transmitting fluid incorporating said well tool also is disclosed.

8 Claims, 4 Drawing Sheets

WELL TOOL WITH SEALING MEANS

BACKGROUND OF THE INVENTION

1. FIELD OF THE INVENTION:

The invention relates to a subterranean well tool for use in water, oil and gas subterranean wells.

2. BRIEF DESCRIPTION OF THE PRIOR ART:

Subsequent to the drilling of an oil or gas well, it is completed by running into such well a string of casing which is cemented in place. Thereafter, the casing is perforated to permit the fluid hydrocarbons to flow into the interior of the casing and subsequently to the top of the well. Such produced hydrocarbons are transmitted from the production zone of the well through a production tubing or work string which is concentrically disposed relative to the casing.

In many well completion operations, it frequently occurs that it is desirable, either during the completion, production, or workover stages of the life of the well, to have fluid communication between the annular area between the interior of the casing and the exterior of the production tubing or workstring with the interior of such production tubing or workstring for purposes of, for example, injecting chemical inhibitor, stimulants, or the like, which are introduced from the top of the well through the production tubing or workstring and to such annular area. Alternatively, it may be desirable to provide such a fluid flow passageway between the tubing/casing annulus and the interior of the production tubing so that actual production fluids may flow from the annular area to the interior of the production tubing, thence to the top of the well. Likewise, it may be desirable to circulate weighting materials or fluids, or the like, down from the top of the well in the tubing/casing annulus, thence into the interior of the production tubing for circulation to the top of the well in a "reverse circulation" pattern.

In instances as above described, it is well known in the industry to provide a well tool having a port or ports therethrough which are selectively opened and closed by means of a "sliding" sleeve element positioned interiorly of the well tool. Such sleeve typically may be manipulated between open and closed positions by means of wireline, remedial coiled tubing, electric line, or any other well known auxiliary conduit and tool means.

Typically, such ported well tools will have upper and lower threaded ends, which, in order to assure sealing integrity, must contain some sort of elastomeric or metallic sealing element disposed in concert with the threads to prevent fluid communication across the male/female components making up the threaded section or joint. A placement of such a static seal represents a possible location of a seal failure and, as such, such failure could adversely effect the sealing integrity of the entire production tubing conduit.

Additionally, in such well tool, a series of upper and lower primary seals are placed in the housing for dynamic sealing engagement relative to the exterior of a sleeve which passes across the seals during opening and closing of the port element. As with all seals, such primary sealing means also represent an area of possible loss of sealing integrity. Thus, such prior art well tools have been commercially manufactured with four possible seal areas, the integrity of which can be compromised at any time during the well life and the usage cf the tool.

During movement of the sleeve to open the port in such well tool to permit fluid communication between the interior and exterior thereof, such primary seals positioned between the interior wall of the well tool housing and the exterior wall of the shifting sleeve will first be exposed to a surge of fluid flow which can cause actual cutting of the primary seal elements as pressure is equalized before a full positive opening of the sleeve and, in some instances, during complete opening of the sleeve. In any event, any time such primary seals are exposed to flow surging, such primary seals being dynamic seals, a leak path could be formed through said primary seals.

Accordingly, the present invention provides a well tool wherein the leak paths as above described are reduced from four to two, thus greatly reducing the chances of loss of sealing integrity through the tool and the tubular conduit. Secondly, the well tool of the present invention also provides, in one form, a fluid diffuser seal element which resists flow cutting damage to the primary seal element by substantially blocking fluid flow thereacross during shifting of the sleeve element between open and closed positions.

Other objects and advantages of the incorporation of use of the present invention will be appreciated after consideration of the drawings and description which follow.

SUMMARY OF THE INVENTION

A downhole well tool is securable to tubular members for forming a section of the cylindrical fluid flow conduit within said well and for selective transmission of fluids therethrough between the interior and exterior of the tool.

The well tool comprises a housing. First and second threaded ends are provided for securing said housing between companion threaded ends of said tubular members. A fluid communication port is disposed through the housing and between the threaded ends. One of the threaded ends is positioned upstream of the port and the other threaded end is positioned downstream of the port. Primary means are interiorly positioned inside each of the tubular members and have a face in abutting relationship with the housing. One of the primary sealing means is positioned downstream of one of the threaded ends, and the other of the primary sealing means is positioned upstream of the other of the threaded ends.

The well tool also includes a sleeve which is disposed interiorly of the housing and is shiftable between first and second positions for selectively communicating and isolating the fluid communication port relative to the interior of the tool.

Each of the primary sealing means has an exterior face in circumferential sealing alignment with the housing and an interior face which is always in circumferential sealing alignment with the sleeve.

The apparatus also includes a flow diffuser ring element which is placed around the interior of the housing and downstream of the port to eliminate damage to the primary seal element downstream thereof such that there is effectively no flow across the primary seals during the shifting of the sleeve.

DESCRIPTION OF THE PREFERRED EMBODIMENTS

Figure 1:
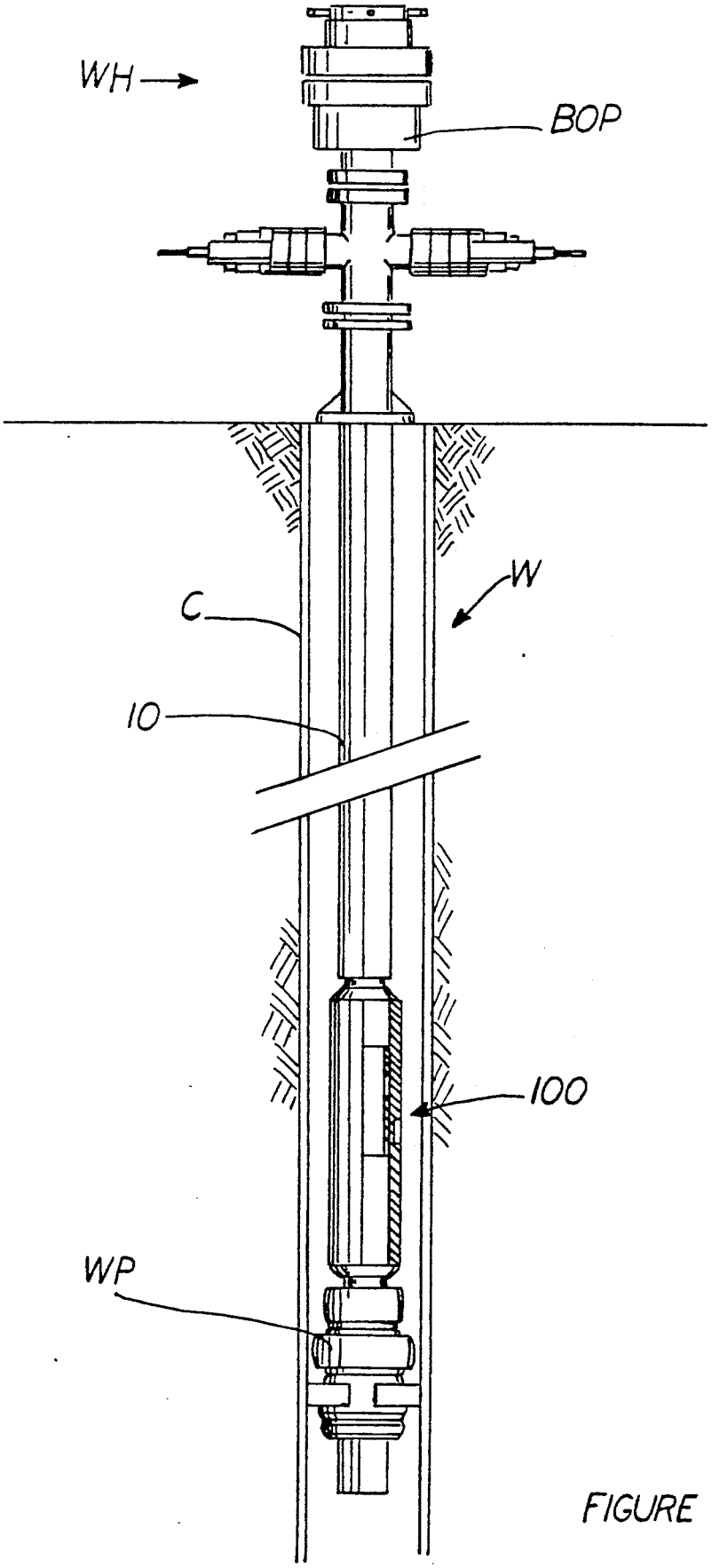
FIG. 1 is a longitudinal sectional view of a subterranean well showing the apparatus positioned above a well packer during actual production of the well.

With first reference to FIG. 1, there is schematically shown the apparatus of the present invention in a well W with a wellhead WH positioned at the top and a blowout preventor BOP positioned thereon.

It will be appreciated that the apparatus of the present invention may be incorporated on a production string during actual production of the well in which the wellhead WH will be in the position as shown. Alternatively, the apparatus of the present invention may also be included as a portion of a workstring during the completion or workover operation of the well, with the wellhead WH being removed and a workover or drilling assembly being positioned relative to the top of the well.

As shown in FIG. 1, the casing C extends from the top of the well to the bottom thereof with a cylindrical fluid flow conduit 10 being cylindrically disposed within the casing C and carrying at its lowermost end a well packer WP. The well tool 100 is shown being carried on the cylindrical fluid flow conduit 10 above the well packer WP.

Figure 2:
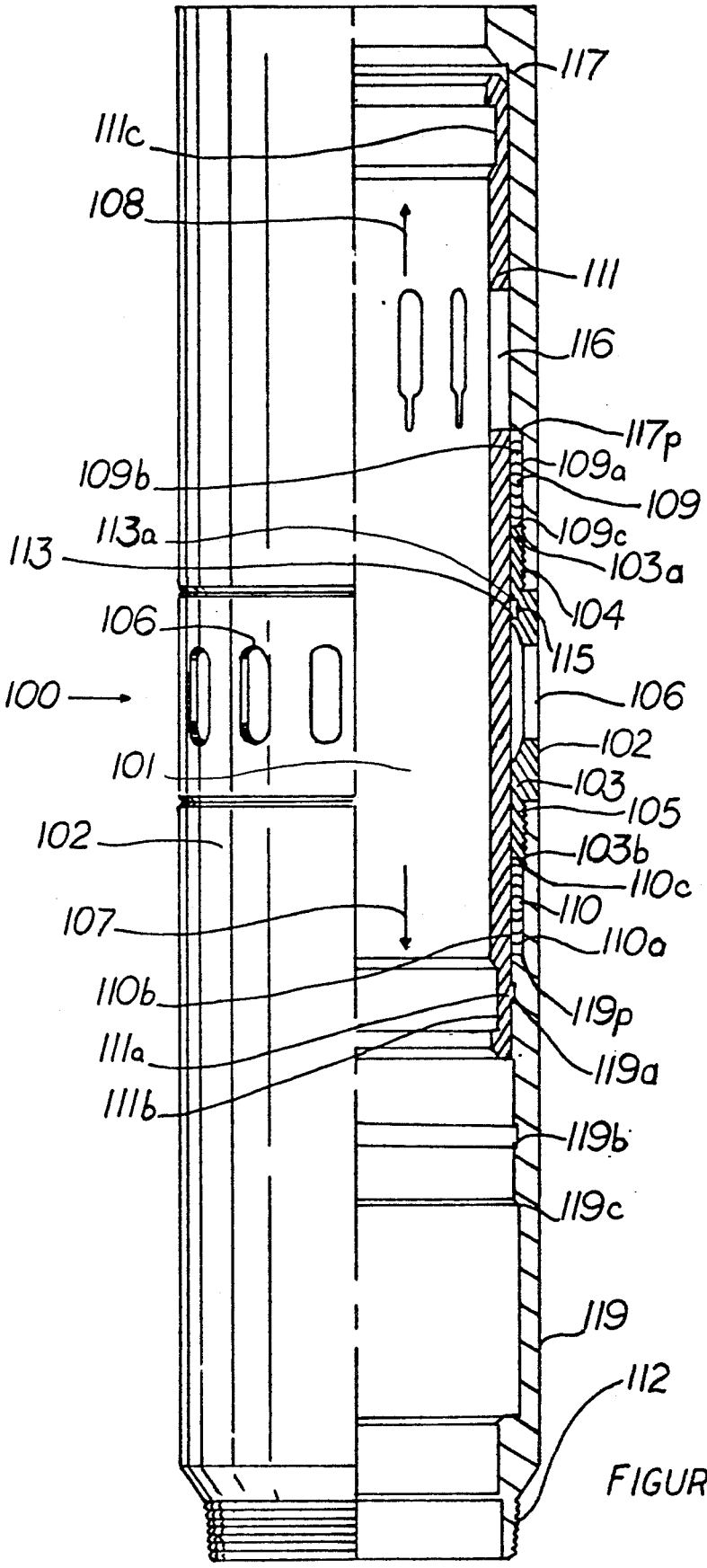
FIG. 2 is a longitudinally extending sectional view, partly interior and partly exterior, of the apparatus of the present invention with the port in fully closed position.

Now with reference to FIG. 2, the well tool 100 is secured at its uppermost end to a first tubular member 117 forming a portion of the cylindrical fluid flow conduit 10, and at its lowermost end to a second tubular member 119 forming the lowermost end of the cylindrical fluid flow conduit 10 and extending on to the well packer WP at threads 112. Alternatively, the well tool 100 of the invention may also be provided in a form wherein members 117, 119 are actual parts of the well tool itself, with members 117, 119 and 103 forming the entire outer housing.

The well tool 100 has a cylindrical interior 101 and an exterior 102 which are permitted to be selectively communicated therebetween by means of a fluid communication port 106.

In the position in FIG. 1, it will be assumed that production fluids are to flow through the cylindrical fluid flow conduit 10 from below the well packer WP to the top of the well, but such flow could be in the opposite direction. Thus with reference to FIGS. 2, 3, and 4, the arrow 108 in the interior of the tool above of the fluid communication port 106 is defined as pointing towards the downstream flow portion relative to the port 106 and the arrow 107 below the fluid communication port 106 is defined as pointing towards the upstream area of the fluid flow, as described The well tool 100 has a primary sealing means 109 downstream of a first threaded end 104. As shown, the sealing means 109 is comprised of a series of Chevron shaped thermoplastic compound elements, but may be in the form and include a number of well known sealing components for sliding sleeve mechanisms utilized in the well completion art.

With reference to FIG. 2, the sealing means 109 includes a lower face **109*c* which is in abutting engagement with the uppermost end 103*a* of the housing 103 which, in effect, is an abutting shoulder for receipt of the lower end of the sealing means 109**.

An interior sealing face **109*f* sealing means 109 projects interiorly of the inner wall of the first tubular member 117 for sealing dynamic contact with a cylindrical shifting sleeve 111 concentrically positioned within the well tool 100. Likewise, the sealing means 109 also have their outer face 109*a* facing exteriorly and away from the sleeve 111 for sealing engagement with the inner cylindrical wall of the first tubular member 117. The sealing means 109 is thus contained within a profile 117*p* of the first tubular member 117**.

The sleeve 111 is normally secured in position for running into the well as shown in FIG. 2, where the fluid communication port 106 is closed. In some operations, for equalization purposes, and the like, the sleeve 111 may be placed in the "open" position such that the fluid communication port 106 is in fluid communication with the interior 101 of the well tool 100 from the exterior 102 thereof. In any event, when the sleeve 111 is in the position where the fluid communication port 106 is in the "open" position, an outwardly extending flexible latch element **111*a* is secured within an upper companion groove 119*a* on the tubular member 119. A shifting neck 111*b* is defined at the lowermost end of the sleeve 111 for receipt of a shifting prong (not shown) of a wireline, coiled tubing, or the like, shifting tool for manipulating the sleeve 111 from one position to another position relative to the fluid communication port 106. As the shifting prong engages the shifting neck 111*b***, a downward load may be applied across the shifting prong through the shifting neck lll*b* the sleeve to move same, such as from the fully "closed" position shown in FIG. 2, to the intermediate equalizing position shown in FIG. 3, or the fully open position shown in FIG. 4. Once sleeve 111 is shifting, latch **111*a* will rest in snapped engagement in the intermediate groove 119*b* upstream of the groove 119*a* and, in such position, the sleeve 111 is in the equalized position. Continued downward movement will move the sleeve 111 to the fully open position, and the latch 111*a* will be in the groove 119*c*. Of course, the sleeve 111 may also be moved by appropriate connection of a shifting tool at an alternate shifting neck 111*c* at the top end of the sleeve 111**.

The fluid flow diffuser ring 113 has an outwardly defined 45 degree angled expansion area 115 around the exterior to permit the components of the fluid flow diffuser ring 113 to expand therein as the well tool 100 encounters increased temperatures and pressures within the well W, during operations. An inner wall **113*a* of the fluid flow diffuser ring 113 will sealingly engage along the exterior surface of the sleeve 111 such that there is substantially no effective fluid flow across the primary sealing means 109 as the sleeve 111 is shifted to open the fluid communication port 106 relative to the interior 101 of the tool 100**.

The fluid flow diffuser ring 113 may be made of any substantially hard nonelastomeric but plastic material such as Polyetheretherkeytone (PEEK), manufactured and available from Green, Tweed & Company, Kulpsville, Pennsylvania. It will be appreciated that the fluid flow diffuser ring 113 is not a conventional elastomeric seal which degrades rapidly during shifting or other "wiper" which only serves the function of wiping solid or other particulate depris from around the outer exterior of the sleeve 111 as it dynamically passes across the sealing means 109 but, rather, the fluid flow diffuser 113 acts to substantially eliminate fluid flow to prevent fluid flow damage to the primary sealing assembly, 109.

Below the fluid communication port 106 and positioned at the lowermost end of the housing 103 in the upstream direction 107 from of the second threaded end 105 is a second sealing means 110 emplaced within a profile 119*p* of the tubular member 119. This sealing means 110 may be of like construction and geometrical configuration as the sealing means 109, or may be varied to accomodate particular environmental conditions and operational techniques.

With reference to FIG. 2, the sealing means 110 has an upper face 110*c* which abutts the lowermost end 103*b* of housing 103 below the second threaded end 105 of housing 103. The outer face of the seals 110*a* is in sealing smooth engagement with the inner wall of the profile 119*p* of the second tubular member 119. Additionally, the interior face 110*b* of sealing means 110 faces inwardly for dynamic sealing engagement with the sleeve 111 positioned thereacross.

OPERATION

The well tool 100 is assembled into the cylindrical fluid flow conduit 10 for movement within the casing C by first securing the housing to the first and second tubular members 117, 119 at their respective threaded ends 104, 105. The sleeve 111 will be concentrically housed within the well tool 100 at that time with the sealing means 109, 110 in position as shown in, for example, FIG. 2.

During makeup, the seal means 109, 110, will, of course, be secured within their respective profiles 117*p* and 119*p* . Now, the first tubular member 117 and/or the second tubular member 119 are run into the well W by extension thereto into a cylindrical fluid flow conduit 10 with, in some instances, the well packer WP being secured at the lowermost end of the second tubular member 119 at, for example, threads 112. If the well tool 100 is run into the well in the closed position, the well tool 100 will be in the position as shown in FIGS. 1 and 2.

Figure 3:
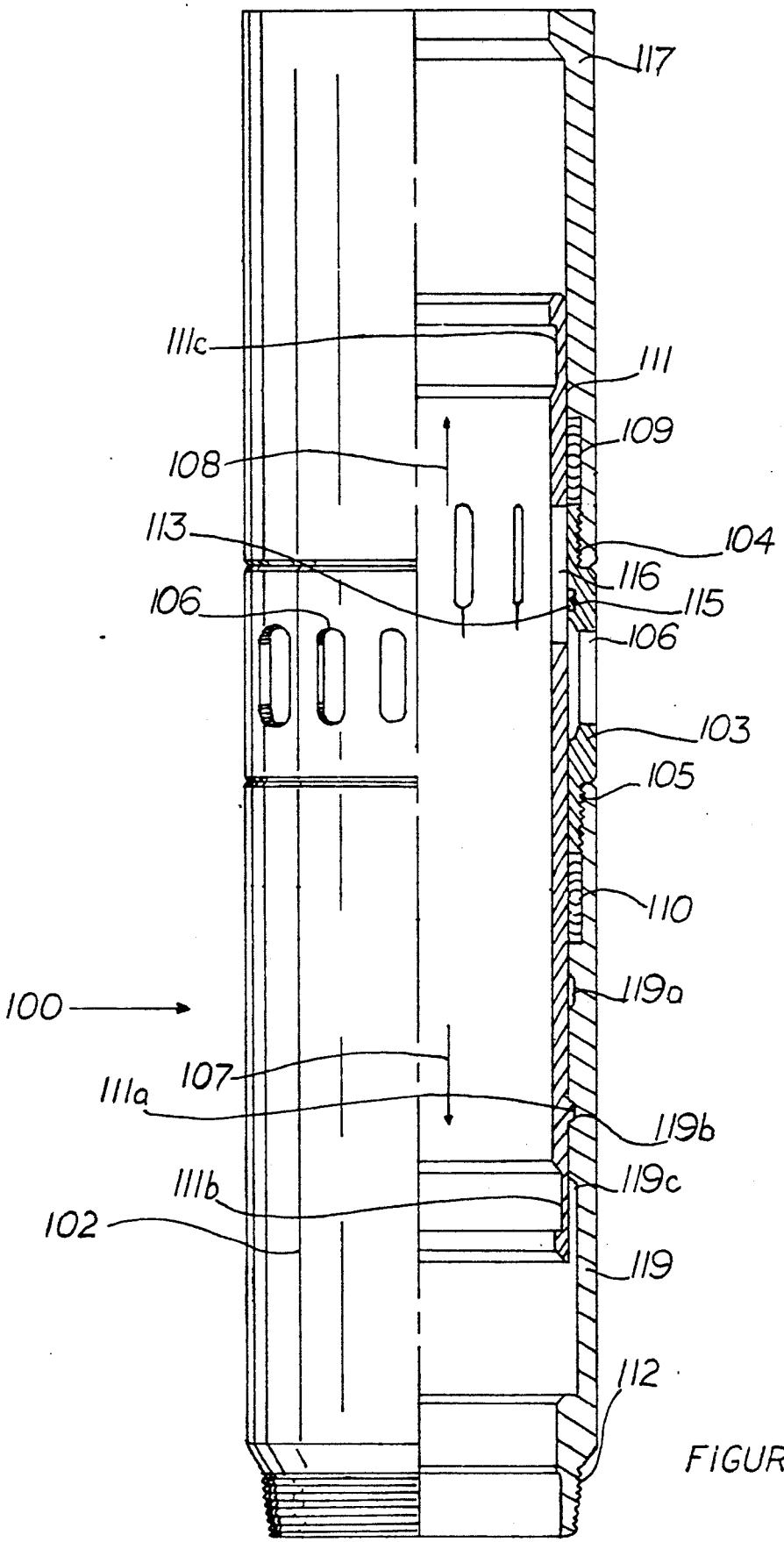
FIG. 3 is a view similar to FIG. 2 showing the apparatus with the sleeve and port in intermediate, or equalizing, position.

When it is desired to open the fluid communication port 106, the sleeve 111 is manipulated from the position shown in FIG. 2 to the position shown in FIG. 3, where pressure exterior of the well tool 100 and interior thereof are first equalized. It will be appreciated that the positioning and location of the sealing means 109, 110 relative to their respective threaded ends 104, 105, eliminate the necessity of a fluid tight seal being required between these threaded members, thus greatly reducing by a factor of 50 percent the number of locations for possible loss of pressure integrity within the well tool 100.

Additionally, it will also be appreciated that such positioning of the primary seals 109 in a position in the downstream direction 108 relative to the fluid flow diffuser 113 such seals from being exposed to fluid flow when the sleeve 111 is shifted from the position shown in FIG. 2, where the fluid communicaton port 106 is isolated from the interior 101 of the tool 100, to the equalizing position, shown in FIG. 3.

Figure 4:
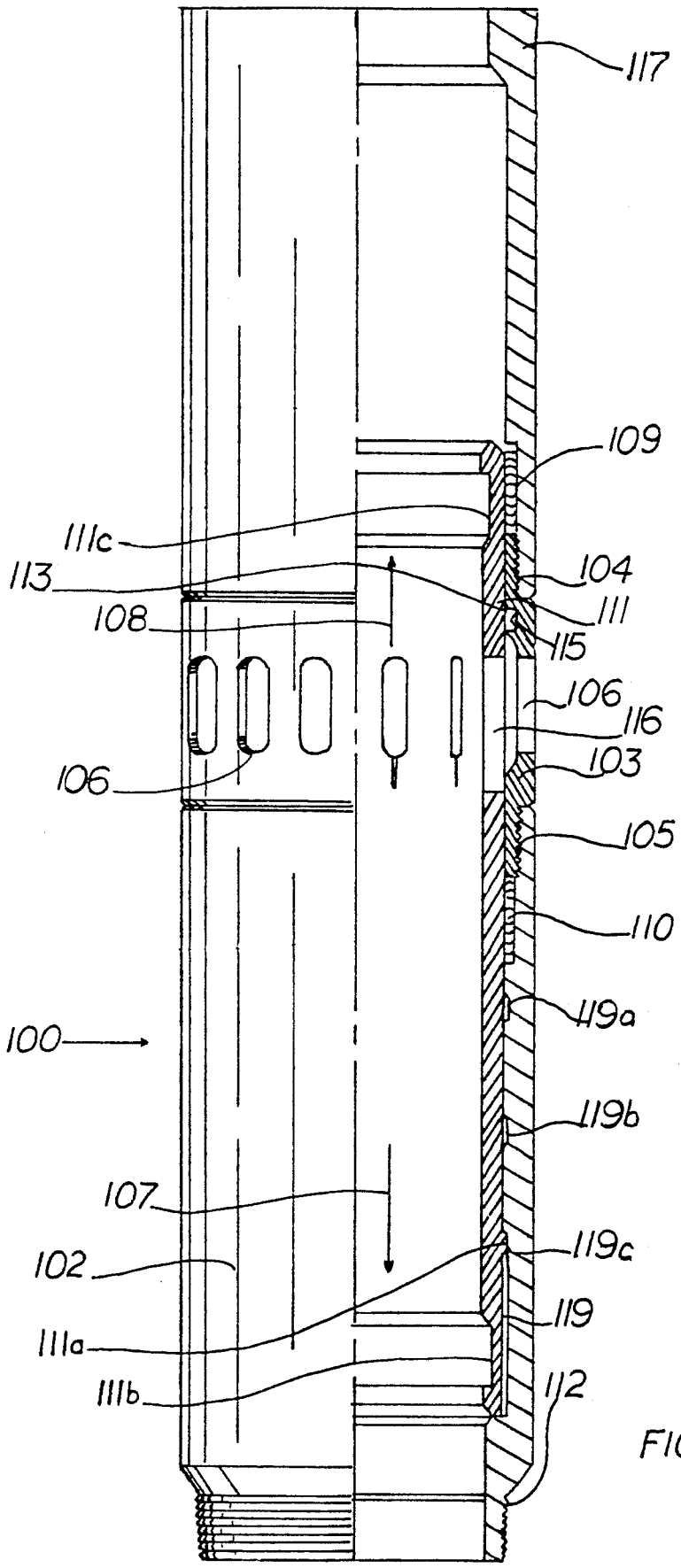
FIG. 4 is a view similar to that of FIGS. 2 and 3 showing the port of the well tool of the present invention being in an open condition.

Subsequent to the shifting of the sleeve 111 to the equalized position, it may be opened fully to the position shown in FIG. 4. Where equalization is not deemed to be a particular problem because of comparative low pressure environments of operation, the tool may, of course, be shifted from the position shown in FIG. 2 to the position shown in FIG. 4, without any sort of time in the equalization position shown in FIG. 3.

Although the invention has been described in terms of specified embodiments which are set forth in detail, it should be understood that this is by illustration only and that the invention is not necessarily limited thereto, since alternative embodiments and operating techniques will become apparent to those skilled in the art in view of this disclosure. Accordingly, modifications are contemplated which can be made without departing from the spirit of the described invention.

What is claimed and desired to be secured by Letters Patent is:

1. A downhole well tool securable to tubular members for forming a section of a cylindrical fluid flow conduit within said well and for selective transmission of fluids therethrough between the interior and the exterior of said tool, said tool comprising:

a housing;

first and section threaded ends for securing said housing between companion ends of said tubular members;

a fluid communication port disposed through said housing and between said threaded ends;

one of said threaded ends being upstream of said port and the other of the threaded ends being downstream of said port;

sealing means interiorly positioned around each of said tubular members and having a face in abutting relationship with said housing, one of said sealing means being positioned downstream of one of said threaded ends, and the other of said sealing means being positioned upstream of the other of said threaded ends; and a sleeve disposed interiorly of said housing and shiftable between a plurality of positions for selectively communicating and isolating said port relative to said interior of said tool, including at least the following positions;

a closed position with said seal means disposed in a substantially enclosed region formed at least in-part by said sleeve in at least limited fluid communication with said interior and exterior regions;

an open position with said seal means disposed in a substantially enclosed region formed at least in-part by said sleeve in at least limited fluid communication with said interior and exterior regions.

2. The well tool of claim 1 further comprising a sleeve disposed interiorly of said housing and shiftable between first and second positions for selectively communicating and isolating said port relative to the interior of said tool.

3. The well tool of claim 2, each of said sealing means having an exterior face in circumferential sealing alignment with said housing, and an interior face always in circumferential sealing alignment with said sleeve.

4. The method of selectively transmitting fluid between the interior and exterior of a downhole well tool securable to a tubular member, said well tool forming a section of a cylindrical fluid flow conduit within said well, said method comprising the steps of:

(a) forming said cylindrical flow conduit at the top of said well be securing between said tubular members the well tool, said well tool comprising:

a housing;

first and second threaded ends for securing said housing between companion threaded ends of said tubular members;

a fluid communication port disposed through said housing and between said threaded ends;

one of said threaded ends being upstream of said port and the other threaded end being downstream of said port;

sealing means being interiorly positioned around each of said tubular members and having a face in abutting relationship with said housing, one of said sealing means being positioned downstream of one of said threaded ends, and the other of said sealing means being positioned upstream of the other of said threaded ends; and a sleeve disposed interiorly of said housing and including a port and shiftable between first and second position for selectively communicating and isolating said fluid communication port relative to the interior of said tool wherein;

in said first position said seal means is disposed in a substantially enclosed region formed at least in-part by said sleeve in at least limited fluid communication with said interior and exterior regions;

in said second position said seal means is disposed in a substantially enclosed region formed at least in-part by said sleeve in at least limited fluid communication with said interior and exterior regions; and (b) running said well tool and said tubular conduit into and through said well and positioning said well tool at a predeterminable location.

5. The method of selectively transmitting fluid between the interior and exterior of a downhole well tool securable to a tubular member, said well tool forming a section of a cylindrical fluid flow conduit within said well, said method comprising the steps of:

(a) forming said cylindrical flow conduit at the top of said well be securing between said tubular members the well tool, said well tool comprising:

a housing;

first and second threaded ends for securing said housing between companion threaded ends of said tubular members;

a fluid communication port disposed through said housing and between said threaded ends;

one of said threaded ends being upstream of said port and the other threaded end being downstream of said port;

sealing means being interiorly positioned around each of said tubular members and having a face in abutting relationship with said housing, one of said sealing means being positioned downstream of one of said threaded ends, and the other of said sealing means being positioned upstream of the other of said threaded ends; and a sleeve disposed interiorly of said housing and including a port and shiftable between first and second positions for selectively communicating and isolating said fluid communication port relative to the interior of said tool, wherein;

in said first position said seal means is disposed in a substantially enclosed region formed at least in-part by said sleeve in at least limited fluid communication with said interior and exterior regions;

in said second position said seal means is disposed in a substantially enclosed region formed at least in-part by said sleeve in at least limited fluid communication with said interior and exterior regions; and (b) running said well tool on said tubular conduit into and through said well and positioning said well tool at a predeterminable location; and (c) shifting said sleeve from a first position wherein said port is isolated relative to the interior of said tool to an intermediate position wherein pressure between the interior of said well tool and the exterior thereof is equalized through said fluid communication port.

6. The method of selectively transmitting fluid between the interior and exterior of a downhole well tool securable to a tubular member, said well tool forming a section of a cylindrical fluid flow conduit within said well, said method comprising the steps of:

(a) forming said cylindrical flow conduit at the top of said well be securing between said tubular members the well tool, said well tool comprising:

a housing;

first and second threaded ends for securing said housing between companion threaded ends of said tubular members;

a fluid communication port disposed through said housing and between said threaded ends;

one of said threaded ends being upstream of said port and the other threaded end being downstream of said port;

sealing means being interiorly positioned around each of said tubular members and having a face in abutting relationship with said housing, one of said sealing means being positioned downstream of one of said threaded ends, and the other of said sealing means being positioned upstream of the other of said threaded ends; and a sleeve disposed interiorly of said housing and including a port and shiftable between first and second positions for selectively communicating and isolating said fluid communication port relative to the interior of said tool, wherein;

in said first position said seal means is disposed in a substantially enclosed region formed at least in-part by said sleeve in at least limited fluid communication with said interior and exterior regions; and (b) running said well tool on said tubular conduit into and through said well and positioning said well tool at a predeterminable location;

(c) shifting said sleeve from a first position wherein said port is isolated relative to the interior of said tool to an intermediate position wherein pressure between the interior of said well tool and the exterior thereof is equalized through said fluid communication port; and (d) further shifting said sleeve to a third position wherein said port is in full fluid communication with the interior of said tool, said diffuser means effectively resisting fluid flow across said downstream sealing means when said sleeve is in one position.

7. The method of selectively transmitting fluid between the interior and exterior of a downhole well tool securable to a tubular member, said well tool forming a section of cylindrical fluid flow conduit within said well, said method comprising the steps of:

(a) forming said cylindrical flow conduit at the top of said well be securing between said tubular members the well tool, said well tool comprising:

first and second threaded ends for securing said housing between companion threaded ends of said tubular members;

a fluid communication port disposed through said housing and between said threaded ends;

one of said threaded ends being upstream of said port and the other threaded end being downstream of said port;

sealing means being interiorly positioned around each of said tubular members and having a face in abutting relationship with said housing, one of said sealing means being positioned downstream of one of said threaded ends, and the other of said sealing means being positioned upstream of the other of said threaded ends; and a sleeve disposed interiorly of said housing and including a port and shiftable between first and second positions for selectively communicating and isolating said fluid communication port relative to the interior of said tool, wherein;

in said first position said seal means is disposed in a substantially enclosed region formed at least in-part by said sleeve in at least limited fluid communication with said interior and exterior regions;

in said second position said seal means is disposed in a substantially enclosed region formed at least in-part by said sleeve in at least limited fluid communication with said interior and exterior regions; and (b) running said well tool on said tubular conduit into and through said well and positioning said well tool at a predeterminable location; and (c) shifting said sleeve from a first position to a second position wherein said sleeve is moved wherein said port is in one of said isolated and full fluid communication positions relative to the interior of said tool.

8. A downhole well tool securable to tubular members for forming a section of a cylindrical fluid flow conduit within said well and for selective transmission of fluid therethrough between the interior and the exterior of said tool, said tool comprising:

a housing;

first and second threaded ends for securing said housing between companion ends of said tubular members;

fluid communication port disposed through said housing and between said threaded ends;

one of said threaded ends being upstream of said port and the other of the threaded ends being downstream of said port;

sealing means interiorly positioned around each of said tubular members;

sleeve means disposed interior of said housing and shiftable between first and second positions for selectively communicating and isolating said port relative to the interior of said tool and including a port for selectively communicating and isolating said fluid communication port relative to the interior of said tool, wherein;

in said first position said seal means is disposed in a substantially enclosed region formed at least in-part by said sleeve in at least limited fluid communication with said interior and exterior regions;

in said second position said seal means is disposed in a substantially enclosed region formed at least in-part by said sleeve in at least limited fluid communication with said interior and exterior regions; and fluid flow diffuser means for effectively restricting fluid flow in a direction opposite the direction of shifting of said sleeve means for selective communication between said fluid communication port and said port in said sleeve means.

* * * * *